United States Patent [19]

Kaucic et al.

[11] Patent Number: 4,827,199

[45] Date of Patent: May 2, 1989

[54] TORQUE RESPONSIVE MOTOR-DRIVE ASSEMBLY

[75] Inventors: Edward M. Kaucic, Watertown; John E. Morris, Lake Mills, both of Wis.

[73] Assignee: Graber Industries, Inc., Middleton, Wis.

[21] Appl. No.: 168,280

[22] Filed: Mar. 15, 1988

[51] Int. Cl.[4] ..... A47H 5/02

[52] U.S. Cl. ..... 318/491; 318/466; 160/331

[58] Field of Search ..... 318/292, 361, 466, 467, 318/468, 429, 491, 538, 541, 542; 160/330, 331

[56] References Cited

U.S. PATENT DOCUMENTS

| | | | |
|---|---|---|---|
| 2,843,691 | 7/1958 | Champion et al. | 200/61.46 |
| 2,912,632 | 11/1959 | Turtil | 318/261 |
| 3,269,454 | 8/1966 | Gill et al. | 160/331 |
| 3,327,194 | 6/1967 | Trapp | 160/331 X |
| 3,331,428 | 7/1967 | Ford | 160/331 |
| 3,372,599 | 3/1968 | Bratschi | 74/89.2 |
| 3,383,576 | 5/1968 | Kordik | 318/491 X |
| 3,478,182 | 11/1969 | Littmann | 200/61.46 |
| 3,672,425 | 6/1972 | Schulze-Robbecke et al. | 160/331 |
| 3,753,457 | 8/1973 | Bratschi et al. | 160/331 |
| 3,808,483 | 4/1974 | Kembuegler et al. | 318/436 |
| 4,085,345 | 4/1978 | Bullat | 310/117 |
| 4,096,903 | 6/1978 | Ringle, III | 318/467 X |
| 4,417,185 | 11/1983 | Bullat | 318/466 X |
| 4,548,250 | 10/1985 | Meharg et al. | 200/52 R X |
| 4,614,900 | 9/1986 | Young | 318/16 |

*Primary Examiner*—Bentsu Ro

*Attorney, Agent, or Firm*—Vernon J. Pillote

[57] ABSTRACT

A traverse rod having a reversible torque responsive motor-drive assembly for operating the traverse rod. The motor-drive assembly includes a stationary casing fixed to the rod and a movable casing mounted in the stationary casing for angular movement relative thereto about a turn axis. A reversible DC motor in the movable casing is connected through a planetary gear speed reducer to a traverse cord drive wheel for applying driving torque thereto. The movable casing is arranged to turn about the turn axis in opposition to the torque applied to the drive wheel and is yieldable urged angularly about the turn axis toward a preselected neutral position relative to the stationary casing. The motor-drive assembly has a torque responsive motor control including stationary brush contacts fixed on the stationary casing and adapted for connection to a power supply and movable electrically conductive segments fixed on the movable casing and electrically connected to the motor. The movable electrically conductive segments include primary segments arranged to engage the brush contacts when the movable casing is in the neutral position and auxiliary segments spaced angularly about the turn axis from the primary segment to engage the brush contacts when the movable casing is turned through a preselected angle in either direction from the neutral position.

21 Claims, 4 Drawing Sheets

TORQUE RESPONSIVE MOTOR-DRIVE ASSEMBLY

BACKGROUND OF THE INVENTION

The present invention relates to a torque responsive motor-drive assembly and more particularly to a torque responsive motor-drive for traverse rods and the like.

Motor operated traverse mechanisms are known in which opening and closing of the traverse mechanism can be initiated either manually by manually operated switches or automatically as by a timer device, photoelectric device, temperature sensing device or the like. In some motor operated traverse mechanisms such as disclosed in U.S. Pat. Nos. 2,912,632; 3,372,599 and 3,672,425, position sensing limit switches are provided to shut off the drive motor when the traverse mechanism has reached a preselected curtain open or curtain closed position. Such position sensing switches not only require proper positioning for actuation by the traverse mechanism at the desired open and closed positions, but also complicate the wiring and, moreover, do not provide any protection for the motor in the event the traverse mechanism is overloaded or becomes stalled intermediate its open and closed positions. Further, if the traverse mechanism holds one of the position sensing limit switches open when the traverse mechanism reaches its open or closed position, provision must be made to enable restarting of the motor in the reverse direction. In some traverse mechanisms such as disclosed in U.S. Pat. No. 3,372,599, a special motor having forward and reverse windings is provided with one winding connected through one limit switch to the power source and the other winding connected through the other limit switch to the power source. In U.S. Pat. No. 2,912,632, a reversible DC motor is used and diodes are connected in parallel with the position sensing limit switches and so arranged that, when the motor drives forward into one of the position sensing limit switches to open it, the motor is deenergized. When the polarity of the voltage is reversed, the associated diode allows the motor to be driven in the reverse direction. Some other motor operated drives for traverse mechanisms such as disclosed in U.S. Pat. No. 3,753,457, use a slip clutche in the motor drive to prevent overloading of the motor. U.S. Pat. No. 3,808,483 discloses a motor drive for a traverse mechanism using a burn-out protected motor.

It is also known to provide torque responsive drives such as disclosed in U.S. Pat. Nos. 2,843,691; 4,085,345 and 4,548,250, in which a pair of torque limit switches are arranged to be operated by a switch actuator to interrupt current to the electric motor when the load on the mechanism driven by the motor exceeds a predetermined load, in either direction of rotation of the motor. Conventional switches have a switch plunger and require a certain amount of travel of the switch plunger before the switch is actuated from one condition to the other, which amount of travel can vary somewhat in different switches. Moreover, conventional switches can only accommodate a limited amount of over-travel of the switch plunger without causing damage to the switch or the switch plunger. It is accordingly necessary to accurately position the limit switches with respect to the limit switch actuator in order to interrupt power to the motor when a predetermined load is exceeded, in either direction of rotation of the motor, and to prevent damage to the switches in the event a sudden or momentary overload causes overtravel of the limit switch actuator. U.S. Pat. No. 3,478,182 discloses a rotary drive mechanism including a torque responsive switch having rotary elements arranged for relative angular movement about the axis of rotation and cam means acting between the elements to effect axial movement therebetween upon relative angular movement, and switch contacts controlled by relative axial movement between the elements.

SUMMARY OF THE INVENTION

It is an object of the present invention to overcome the disadvantages of the prior art by providing an improved reversible motor-drive assembly having a torque responsive control for interrupting power to the motor when the load on the mechanism driven by the motor exceeds a predetermined load in either direction of rotation of the motor, which is economical to fabricate and assemble, reliable in operation and compact in construction.

Another object of the present invention is to provide a traverse rod having a reversible torque responsive motor-drive assembly in accordance with the foregoing object, and in which the motor-drive assembly is substantially concealed when the traverse rod is viewed from the front and end of the rod.

Accordingly, the present invention provides a reversible torque responsive motor-drive assembly comprising stationary casing means, movable casing means mounted on the stationary casing means for angular movement relative thereto about a turn axis, drive means on the movable casing means having a rotary output member and a reversible DC motor means drivingly connected to the output member for applying driving torque thereto, the drive means being arranged to apply torque to the movable casing means tending to turn the movable casing means about the turn axis in opposition to the torque applied to the output member, and means yieldably urging the movable casing means angularly about the turn axis toward a preselected neutral position relative to the stationary casing means. The motor-drive assembly has a torque responsive control including stationary electric terminal means fixed to the stationary casing means and adapted for connection to a power supply, and movable electric terminal means fixed on the movable casing means and electrically connected to the motor. One of the terminal means includes brush contact means and the other terminal means includes primary electrically conductive segment means arranged to engage the brush contact means when the movable casing means is in a preselected angular position, first auxiliary electric segment means spaced angularly about the turn axis from the primary electrically conductive segment means to engage the brush contact means when the movable casing means is turned through a preselected angle in the first direction from the neutral position, and second auxiliary electrically conducted segment means spaced angularly about the turn axis from the primary electrically conductive segment means to engage a brush contact means when a movable casing means is turned to a preselected angle in a second direction from the neutral position.

The torque responsive motor-drive assembly is advantageously used in a traverse rod for driving the traverse cord to move the drapery carriers along the rod between open and closed positions. The torque responsive motor-drive assembly is mounted on a pulley housing at one end of the rod to extend rearwardly therefrom alongside a rod mounting bracket, such that the motor-drive assembly is substantially concealed, when the traverse rod is viewed from a position at the front thereof.

DESCRIPTION OF THE PREFERRED EMBODIMENT

Figure 1:
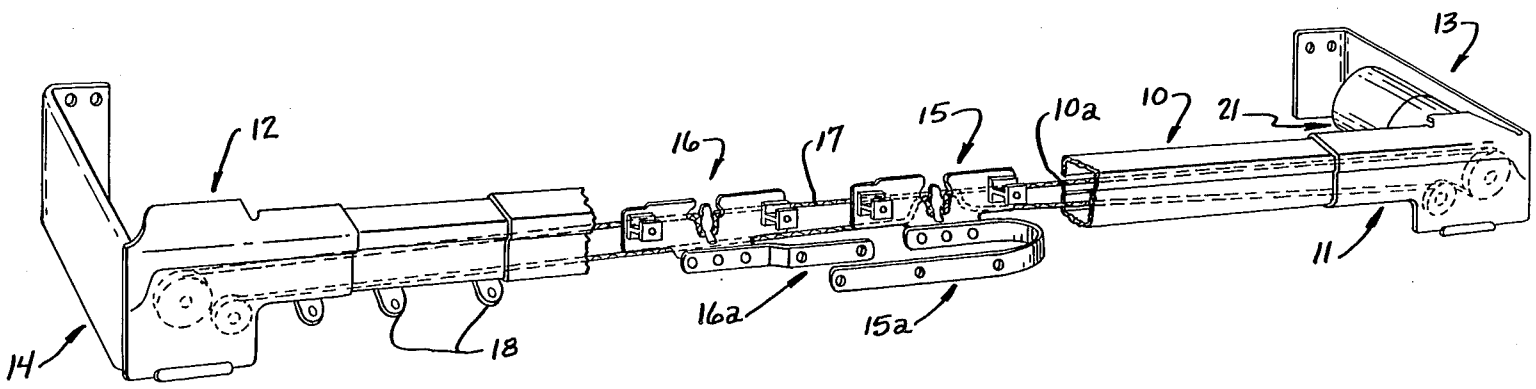
FIG. 1 is a perspective view of a traverse rod embodying the torque responsive motor-drive assembly of the present invention.
Figure 2:
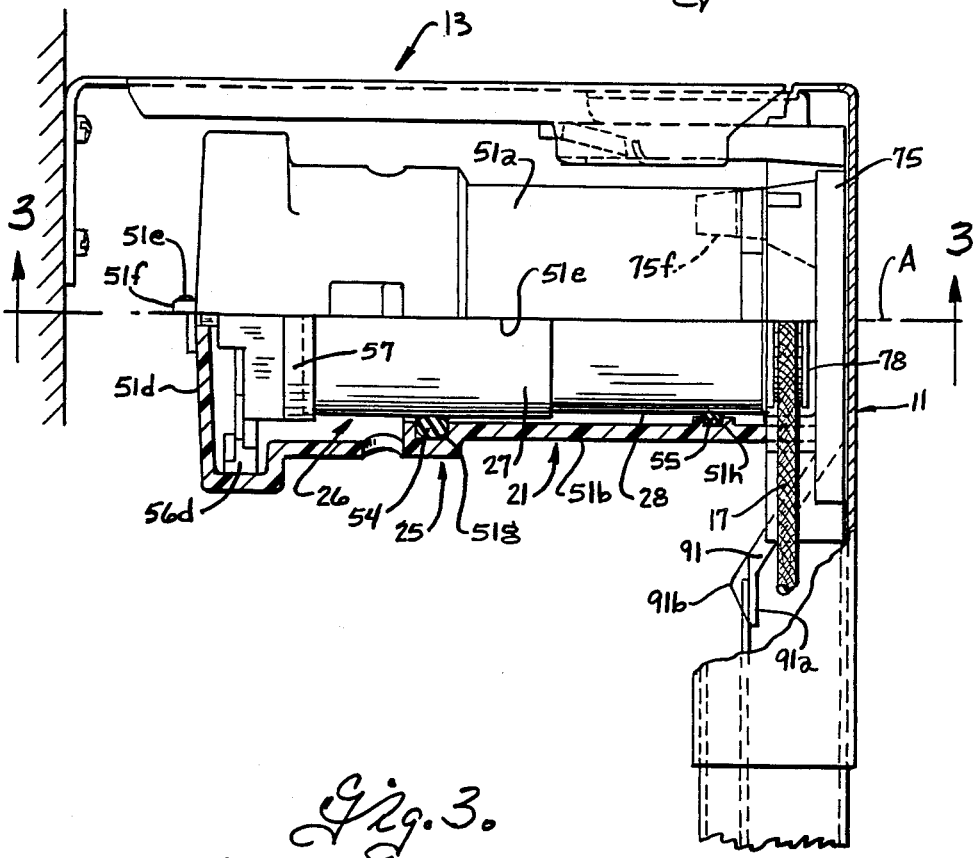
FIG. 2 is a fragmentary plan view illustrating the torque responsive motor-drive assembly mounted on the pulley housing of a traverse rod.
Figure 3:
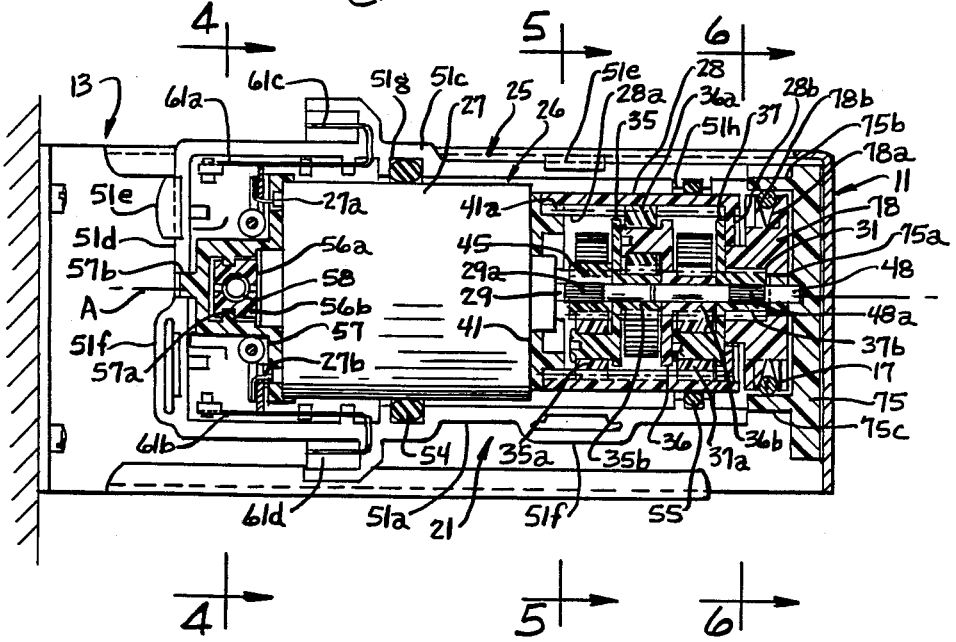
FIG. 3 is a vertical sectional view taken on the plane 3—3 of FIG. 2.

FIG. 1 illustrates a traverse rod 10 having pulley housings 11 and 12 adjacent opposite ends and wall mounting brackets 13, 14 that engage the pulley housings 11 and 12 respectively for supporting a traverse rod on a support surface such as wall, window casing or the like. The rod 10 is preferably of the type having a slot 10*a* defining a trackway at its rear side, and master carrier means 15,16 and auxiliary carrier means 18 are mounted on the trackway for movement along the rod. As is conventional, a traverse cord means 17 is connected to the master carrier means for moving the same along the rod and the master carrier means 15, 16 have drapery support arms 15*a*, 16*a* respectively for supporting the lead edge of a drapery or curtain to move the same between an open and closed position. A torque rsponsive motor-drive assembly 21 is provided for driving the traverse cord means 17 to move the master carriers along the rod between open and closed positions. As best shown in FIGS. 1–3, the torque responsive motor-drive 21 is advantageously mounted on one of the pulley housings 11 in a manner to extend rearwardly from that pulley housing alongside the associated rod support bracket 13, so as to be substantially concealed when viewed from the front and end of the rod.

The torque responsive motor-drive assembly 21 includes a stationary casing means 25 and a movable casing means 26 mounted in the stationary casing means for turning movement relative thereto about a turn axis A. The movable casing means includes a motor casing 27 and a speed reducer casing 28 fixed to one end of the motor casing for movement as a unit therewith. A drive means is provided in the movable casing means and includes a DC motor of conventional construction and having a stator disposed in the motor casing means and a rotor in the stator with a motor shaft 29 extending from one end of the motor. The motor casing 27 preferably has a generally cylindrical configuration and the motor shaft 29 is disposed coaxial with the motor casing. A speed reducer means is provided in the speed reducer casing 28 and is arranged to drivingly connect the motor shaft 29 to a rotary output member 31 to drive the same at a reduced speed and in a manner to apply torque to the movable casing means tending to turn the movable casing means about the turn axis A in opposition to the torque applied to the output member.

Figure 5:
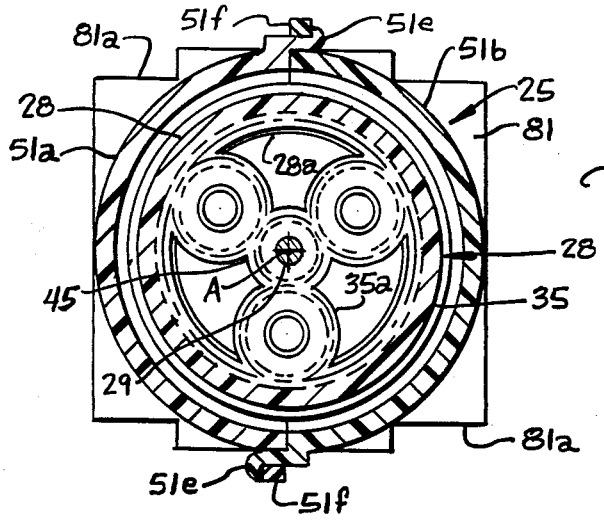
FIG. 5 is a transverse sectional view taken on the plane 5—5 of FIG. 3 and illustrating parts on a larger scale than FIG. 3.

The speed reducing mechanism is advantageously of the planetary gear type and, as best shown in FIGS. 3 and 5, is a three-stage planetary gear assembly including a first planet carrier 35, a second planet carrier 36 and a third planet carrier 37. A ring gear for the several stages of the planetary gear mechanism is advantageously formed integrally with the speed reducer casing 28 and, as shown, ring gear teeth 28*a* are molded integrally on the inner side of the speed reducer casing 28. One end of the speed reducer casing 28 is non-rotatably fixed to the end of the motor by an end cap 41 that is bolted or otherwise fixedly secured to one end of the motor casing, and which end cap has an externally splined portion 41*a* that interfits with the ring gear teeth 28*a*. Any suitable means may be provided for retaining the speed reducer casing 28 against axial separation from the end cap 41.

As best shown in FIG. 3, a drive gear 45 is nonrotatably secured as by a press fit onto a knurled portion 29*a* of the motor shaft 29. The planet carrier 35 is rotatably supported on an end portion of the motor shaft 29 and has one or more planet gears 35*a* at one side that mesh with the drive gear 45 and with the teeth 28*a* of the ring gear. Planet carrier 35 has a sun gear 35*b* at the side opposite the planet gears 35*a* and planet carrier 36 has one or more planet gears 36*a* that mesh with the sun gear 35*b* and with the teeth 28*a* of the ring gear. Planet carrier 36 has a sun gear 36*b* at the side opposite the planet gears 36*a* and planet carrier 37 has planet gears 37*a* that mesh with the sun gear 36*b* and with the teeth 28*a* of the ring gear. The rotary output member 31 is conveniently formed by a sun gear 37*b* on the planet carrier 37 at the side opposite the planet gears 37*a*. With this arrangement, the planet carriers 35, 36 and 37 can be of the same configuration to reduce the number of different parts which must be fabricated, and the planet gears can also be of like configuration. An extension shaft 48 has one end rotatably received in the sun gear 35*b* and extends therefrom through the planet carriers 36 and 37 to support the planet carriers for relative rotation in axial alignment with each other. The extension shaft is conveniently formed with a knurled portion that is press fit into one of the planet carriers 36 or 37 to hold the extension shaft in the drive assembly. A flange 28*b* on the speed reducer casing 28 is arranged to engage the outer face of the planet carrier 37 to retain the planet carriers in assembled relation in the casing.

Thus, the rotary output member 31 is coaxial with the motor axis and with the turn axis A and, when the motor is energized to rotate the motor shaft 29 in either direction, the speed reducer will drive the output member 31 at a reduced speed and correspondingly higher driving torque. The ring gear of the planetary gear speed reducing mechanism is coaxial with the turn axis A so that the driving torque on the output member 31 produces a reaction torque on the movable casing means tending to turn the movable casing means about the turn axis A in opposition to the driving torque applied to the output member. The direction and magnitude of the reaction torque on the movable casing means is correlative in magnitude and opposite in direction to the drive torque applied to the output member 31.

The stationary casing means 25 preferably has at least a portion thereof extending around the movable casing means 26. In the preferred embodiment illustrated, the stationary casing means is formed in two half-sections 51*a* and 51*b* that extend lengthwise of the movable casing means 26. The casing half-sections 51*a* and 51*b* are advantageously of like configuration to minimize the number of parts which must be fabricated and are adapted to abut each other along lengthwise extending faces 51*c*. The casing sections 51*a* and 51*b* have a generally semicylindrical configuration with an end wall 51*d* at one end. The casing sections 51*a* and 51*b* are conveniently molded of a synthetic resin material and latches 51*e* and keepers 51*f* are formed on the sections at locations to interfit with a snap fit to hold the casing sections in assembled relation.

As previously described, the movable casing means 26 is mounted on the stationary casing means for turning movement relative thereto about the turn axis A. This is advantageously achieved by a ring 54 of resilient material that is axially located in the stationary casing means as by a groove 51*g* formed in the inner surface of the casing sections. The ring 54 is formed of a resilient material such as a rubber O-ring and has an undistorted thickness somewhat greater than the depth of the groove 51*g* and such as to engage the outer periphery of the movable casing means such as the motor casing 27. The resilient ring 54 allows the movable casing means to turn relative to the stationary casing means in response to applied torque, but dampens the turning movement and also dampens sound transmission from the motor to the stationary casing means. A second resilient ring 55 is also advantageously provided in a recess 51*h* in the stationary casing means at a location to engage the speed reducer casing 28. The resilient ring 55 has an undistorted depth greater than the depth of the recess 51*h*, but such as to only loosely surround the casing section 28, to accommodate some radial shifting of the casing 28 relative to the stationary casing means, for a purpose which will become apparent hereinafter.

Figure 4:
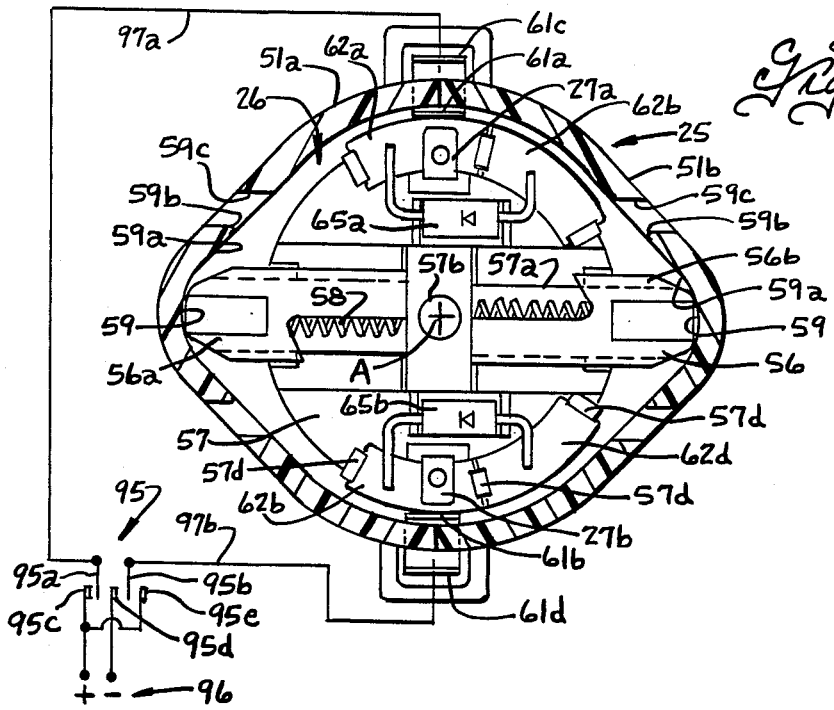
FIGS. 4 and 4*a* are transverse sectional views taken on the plane 4—4 of FIG. 3, illustrating parts on a larger scale and in different moved positions.
Figure 4A:
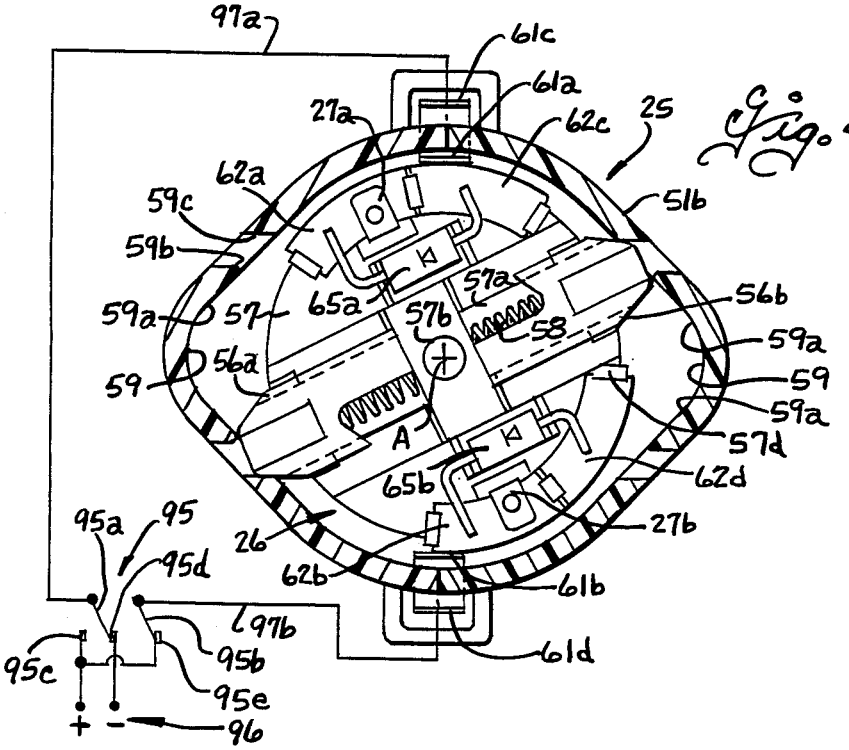

Means are provided to yieldably urge the movable casing means 26 angularly about the turn axis A toward a preselected angular position relative to the stationary casing means. In the preferred embodiment illustrated, plungers 56*a* and 56*b* are mounted on the movable casing means and arranged to engage cam surfaces 59 on the stationary casing means, to normally urge the movable casing means to a preselected neutral position relative to the stationary casing means, shown in FIGS. 2–4. An end cap 57 is fixedly mounted on one end of the motor casing 27, and the plungers 56*a* and 56*b* are slidably mounted in guideways 57*a* formed on the end cap for movement relative to each other in a direction generally radially of the turn axis A. The end cap is advantageously formed with a trunnion 57*b* that extends axially of the turn axis A and is rotatably supported in an opening in the end wall 51*d* of the stationary casing means. A compression spring 58 is interposed between the plungers and guidably supported thereby to yieldably urge the plungers radially outwardly in relatively opposite directions into engagement with the cam surfaces 59 formed in the stationary casing means. As best shown in FIGS. 4 and 4*a*, the cam surfaces 59 define a well with ramp portions 59*a* extending from opposite sides of the well and arranged to cam the plungers radially inwardly and progressively compress the spring 58 as the movable casing means is turned angularly in either direction from the neutral position shown in FIG. 4. A stop notch or recess 59*b* is formed at the ends of the ramp portions 59*a* remote from the well and the stop notches each have a stop shoulder 59*c* engageable with a plunger to limit angular movement of the movable casing means from the preselected neutral position shown in FIG. 4. The spring 58 and the ramp portions 59*b* of the cam surfaces 59*a* are selected such that a preselected torque is required to turn the movable casing means angularly from the neutral position shown in FIG. 4 to a stop position with the plungers engaging the opposed pair of stop notches, such as shown in FIG. 4*a*.

The DC motor in motor casing 27 is of conventional construction and has motor leads 27*a*, 27*b* and is adapted for reversible operation in a direction correlative with the polarity of the voltage applied to the motor leads. In accordance with the present invention, stationary electric terminal means are fixed on the stationary casing means and adapted for connection to a reversible DC power supply source, and movable electric terminal means are fixed on the movable casing means and electrically connected to the motor. One of the terminal means includes brush contact means and the other of the terminal means includes a plurality of electrically conductive segments arranged to engage the brush contact means in different angular positions of the movable casing means. In the preferred embodiment illustrated, the stationary electric terminal means includes brush contact members 61*a* and 61*b* and the movable contact means includes a plurality of electrically conductive segments 62*a*–62*d*. The brush contact members 61*a* and 61*b* are conveniently formed of strips of resilient metal and are mounted in recesses formed at the interengaging faces of the stationary casing means. As best shown in FIG. 3, the brush contact members have a U-shaped portion intermediate their ends and the U-shaped intermediate portion is disposed in complementary recesses formed at the interengaging faces of the stationary casing sections. The brush contact members terminate at their outer ends in terminals 61*c* and 61*d* adapted for connection as by plug-in type connectors (not shown) to a DC power supply.

The end cap 57 is formed of an electrically non-conductive material such as plastic and electrically conductive segments 62*a* and 62*b*, hereinafter sometimes referred to as primary electrically conductive segment means, are mounted on the end cap 57 at locations to engage the brush contact members 61*a* and 61*b*, when the movable casing is in the neutral position shown in FIG. 4 relative to the stationary casing. Electrically conductive segment 62*c*, hereinafter sometimes referred to as a first auxiliary segment means, is spaced angularly from the primary segment 62*a* in a direction and at a location so as to engage the brush contact member 61*a*, when the movable casing means is turned through a preselected angle in one direction from the neutral position, and electrically conductive segment 62*d*, hereinafter sometimes referred to as a second auxiliary segment, is angularly spaced about the turn axis from the primary segment 62*b* in a direction and at a location to engage the brush contact member 61*b* when the movable casing is turned through a preselected angle in a second direction from the neutral position shown in FIG. 4. The segments 62*a*–62*d* have arcuate outer surfaces arranged to slidably engage the brush contact members, and the angular position of the segments is arranged so that primary segment 62*a* moves out of engagement with brush contact member 61*a* and auxiliary segment 62*c* moves into engagement with the brush contact member 61*a* when the movable casing is turned in one direction through a preselected angle from the neutral position to the stop position shown in FIG. 4*a*, while the other primary segment 62*b* is arranged to remain in contact with the brush contact member 61*b* when the movable casing is turned to the stop position shown in FIG. 4*a*. Similarly, primary segment 62*b* is arranged to move out of engagement with brush contact member 61*b* and auxiliary segment 62*d* is arranged to move into engagement with brush contact member 61*b*, when the movable casing is turned through a preselected angle in the other direction from the neutral position shown in FIG. 4 to the other stop position, while primary segment 62*a* is arranged to remain in contact with the brush contact 61*b*.

The segments 62*a*–62*d* can conveniently be mounted on the end cap 57 by a press fit into notched retainer lugs 57*d* formed integrally with the end cap 57. Motor leads 27*a* and 27*b* are electrically connected to the primary segments 62*a* and 62*b* by any suitable means, for example by soldering or welding. As previously described, the plungers 56 are biased radially outwardly by spring 58 into engagement with cam faces 59*a* on the stationary casing means and yieldably urge the movable casing means angularly relative to the stationary casing means to the neutral position shown in FIG. 4. The spring 58 and cam surface 59 are so arranged that the movable casing means will turn from the neutral position shown in FIG. 4 and into engagement with one of the stop notches 51*b* as shown in FIG. 4*a* when the torque load on the rotary output member 31 exceeds a preselected value. The stop shoulders 59*c* on the stop notches 59*b* stop angular movement of the movable casing means when it has reached a preselected angular position and the stop notches are preferably so arranged as to releasably retain the movable casing means in the angularly displaced stop position until the direction of the rotation of the motor is reversed by reversing the application of power thereto. A first diode 65*a* is electrically connected to one of the auxiliary segments 62*c* and also electrically connected to the associated primary segment 62*a* and hence to the motor lead 27*a*. A second diode 65*b* is connected to the auxiliary segment 62*d* and electrically connected to the associated primary segment 62*b* and hence to the other motor lead 27*b*. The diodes 65*a* and 65*b* are arranged so that, when voltage of one polarity is applied to the brush contact members 61*a* and 61*b* and the load on the output member causes the movable casing to turn in one direction out of engagement with one primary segment and into engagement with the associated auxiliary segment, the diodes will prevent the application of power to the motor until the polarity of the applied voltage is reversed. When the applied voltage is reversed, the diode associated with the auxiliary segment that is in contact with a stationary brush contact members, will operate to pass current in the reverse direction to the associated primary segment and hence to the motor.

Figure 6:
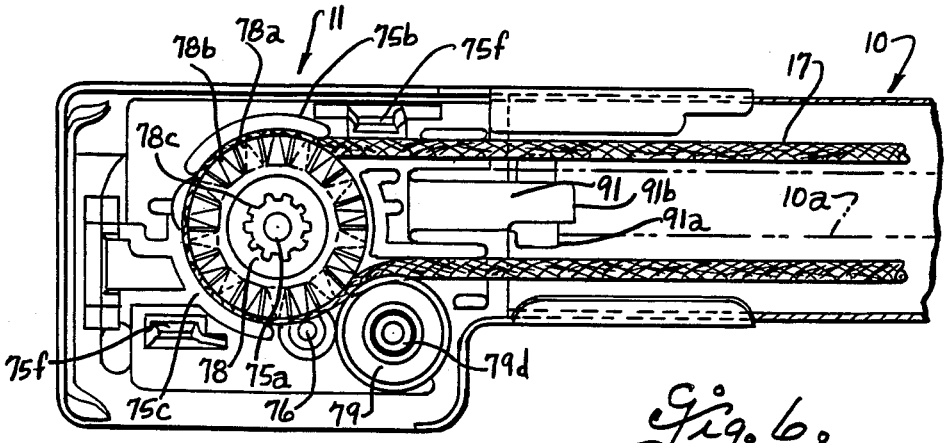
FIG. 6 is a fragmentary transverse sectional view taken on the plane 6—6 of FIG. 3.

The torque responsive motor drive assembly disclosed herein is particularly adapted for motorized operation of a traverse rod. As best shown in FIGS. 2, 3 and 6, a pulley housing adapter plate 75 is mounted on the pulley housing 11 at the rear side thereof as by fasteners 76 (FIG. 6). The pulley housing adapter plate has a rearwardly extending boss 75*a* and a traverse cord drive wheel 78 is rotatably supported on the boss for driving the traverse cord 17. In order to improve traction between the drive wheel and the traverse cord, the wheel is formed with a toothed periphery in which teeth 78*a* and 78*b* of generally wedge shaped cross section are spaced around the periphery of the wheel at opposite sides of a plane perpendicular to the axis of the wheel, and with the teeth 78*a* angularly offset with relation to the teeth 78*b* so that the traverse cord is forced into a slightly undulating path as it passes around the wheel. The teeth 78*a* and 78*b* define a generally V-shaped cord receiving notch and the pulley adapter plate 75 is formed with cord guide portions 75*b* and 75*c* that extend part way around the periphery of the drive wheel and spaced therefrom in relation to the traverse cord diameter so as to press the traverse cord into the V-shaped notch in the drive wheel as the cord passes around the wheel. A cord guide pulley 79 is also mounted on a boss 79*d* on the pulley adapter plate at a location to engage the traverse cord adjacent the wheel.

The stationary casing means is detachably mounted on the pulley adapter plate 75. As shown in FIG. 5, the stationary casing means has a flange 81 at one end with notches 81*a* in the periphery of the flange. The flange 81 is adapted to abut against the rear edges of the cord guides 75*b* and 75*c* on the pulley adapter plate and the pulley adapter plate is formed with latches 75*f* that extend rearwardly therefrom at locations to extend through selected ones of the notches 81*a* in the flange 81. The latches 75*f* are arranged to snap over the flange 81 on the stationary casing means when it is moved toward the adapter plate, and to latch the stationary casing means to the adapter plate. Since the latches extend into notches 81*a* in the periphery of the flange 81, they also locate and hold the stationary casing against turning relative to the pulley housing.

The cord drive wheel 78 has an internally splined opening 78*c* that non-rotatably receives the rotary output member 31 and, as shown in FIG. 3, the boss 75*a* on the adapter plate also has a hole for receiving the end of the extension shaft 48. With this arrangement, the forward end of the extension shaft 48 is radially supported and located on the adapter plate while the boss 75*a* supports the drive wheel 78 substantially concentric with the shaft. The resilient ring 55 in the stationary casing means is dimensioned to allow the forward end of the movable casing means to shift laterally slightly relative to the stationary casing means to facilitate alignment of the extension shaft 48 with the drive wheel. The resilient ring 55, however, has a radial thickness greater than the depth of the recess in the stationary casing means to provide a resilient abutment between the stationary casing means and the movable means.

The pulley housing adapter plate is also advantageously formed with a slide gate 91. As best shown in FIGS. 2 and 6, the slide gate 91 has one end formed integrally with the pulley housing adapter plate and extends rearwardly and laterally therefrom to a location adjacent the end of the rod 10. The slide gate has flanges 91*a* arranged to engage the inner side of the rod at opposite sides of the slot in the rod, and a portion 91*b* that extends rearwardly through the slot to facilitate pressing of the slide gate laterally away from the inner side of the slot, during insertion and removal of auxiliary carriers 16 from the track.

As best shown in FIGS. 1–3, the torque responsive reversible drive assembly, when mounted on the pulley housing, extends rearwardly therefrom alongside the rod mounting bracket 13, so that the drive assembly is substantially concealed when the rod is viewed from a position at the front and end of the rod. Various different arrangements can be utilized to reversibly apply DC power to the input terminals 61c and 61d. A schematic circuit is shown in FIGS. 4 and 4a and includes a switch 95 connected to a source of DC power designated 96 and arranged to apply power to the terminals 61c and 61d. The motor is preferably a low voltage DC motor, for example 6 or 12 volt motor, and the DC power can be supplied from a battery or from an AC power converter that supplies DC output. Switch 95 can be of the manually or by remote control or arranged for automatic operation from a timer, photoelectric devices, temperature sensing devices or the like, as is well known in the art. As shown, switch 95 includes switch members 95a and 95b connected through leads 97a and 97b to the input terminals 61c and 61d of the reversible DC motor. Switch contacts 95c and 95e are connected to one side of the DC power supply, herein shown as the positive side, and switch contact 95d is connected to the other or negative side of the power supply 96. Switch 95 is diagrammatically illustrated as having a center "off" position and switch members 95a and 95b are selectively movable into engagement with contacts 95c and 95d respectively to apply power of one polarity to the motor and alternately movable into engagement with contacts 95d and 95e respectively to apply power of the opposite polarity to the DC motor.

As previously described, the plungers 56a, 56b on the movable casing means engage the cam surfaces 59 on the stationary casing means and yieldably urge the movable casing means angularly relative to the stationary casing means toward the neutral position shown in FIG. 4. When the movable casing means is in the neutral angular position, primary segments 62a and 62b engage the brush contacts 61a and 61b. Thus, when switch 95 is operated to supply power to the input terminals of the motor, the motor will be driven in a direction correlative with the polarity of the voltage supplied through switch 95. For example, when the switch members 95a and 95b are moved into engagement with contacts 95d and 95e respectively, brush contact 61b is positive and brush contact 61a is negative, and the motor will be rotated in one direction to drive the output member in one direction (clockwise as viewed in FIG. 4.) Primary segments 62a and 62b will remain in engagement with the brush contacts 61a and 61b respectively, until the load on the rotary output member 31 exceeds a preselected load, as would occur when the drapery carriers engage an obstruction either intermediate the ends of their travel or at one of the limits of travel. When the load on the output member exceeds the preselected value, the reaction torque on the movable casing means causes the movable casing means to turn relative to the stationary casing means in a direction opposite the direction of applied torque, for example in a counterclockwise direction as viewed in FIGS. 4 and 4a, until the movable casing means reaches a stop position at one of the stop notches 59b. As the movable casing means moves to its stop position in a counterclockwise direction as viewed in FIGS. 4 and 4a, primary segment 62a moves out of engagement with brush contact 61a and auxiliary segment 62c moves into engagement with contact 61a. The other primary segment 62b remains in engagement with brush contact 61b. When primary segment 62a moves out of engagement with brush contact 61a, power to the motor is interrupted until the polarity of the voltage is reversed. When the polarity of the voltage applied to brush contact 61a is changed to positive, power is then supplied through diode 65a to the primary segment 62a and to the motor lead 27a connected thereto. The motor will then be driven in a reverse direction and reaction torque on the movable casing means causes the plungers to move away from the stop notch 59b until the plungers engage ramp portions 59a and urge the movable casing means back to the neutral position shown in FIG. 4. As will be seen from FIGS. 4 and 4a, primary segment 62a and auxiliary segment 62c are angularly positioned relative to each other and to the stop notches 59b in the cam surfaces 59 such that segment 62a moves out of engagement with brush contact 61a and segment 62c moves into engagement with brush contact 61a when the movable casing means is turned in a first direction from the neutral position shown in FIG. 4 through any angle to a first stop position at which the plungers engage one of the stop notches 59b. Similarly, primary segment 62b and auxiliary segment 62d are positioned on the movable casing means relative to the stop notches 59b in the cam surfaces 59 such that the primary segment 62b moves out of engagement with the brush contact 61b and auxiliary segment 62d moves into engagement with brush contact 61b, when the movable casing means is turned in the opposite direction from the neutral position shown in FIG. 4 through an angle to a second stop position at which the plungers engage the other of the stop notches 59b. With this arrangement, the angular position at which one of the primary segments moves out of engagement with the associated brush contact means to interrupt power to the motor can be accurately controlled in accordance with the angular position of the movable casing means. Accordingly the overload torque on the output member 31 required to move the casing means from the neutral position to either stop position can be accurately controlled by the plungers and spring 58. When the torque responsive motor-drive assembly is used in a traverse rod, the spring 58 is selected so that the torque load on the rotary output member 31 required to turn the movable casing means from its neutral position to either of the stop positions, exceeds the drive torque normally required to move the master and auxiliary carriers and draperies along the rod. When the torque load on the rotary output member exceeds the normal drive torque, the movable casing means turns relative to the stationary casing means to one or the other stop positions, to interrupt power to the drive motor and prevent overloading or overheating of the motor.

The embodiments of the invention in which an exclusive property or privilege is claimed are defined as follows:

1. A reversible torque responsive motor-drive assembly comprising, (a) a stationary casing means and a movable casing means mounted on the stationary casing means for turning movement relative thereto about a turn axis, (b) drive means in the movable casing means having a rotary output member and reversible directcurrent motor means having first and second motor leads and a motor shaft drivingly connected to said output member for applying driving torque thereto, said drive means being arranged to apply torque to said movable casing means tending to turn said movable casing means about said turn axis in opposition to the torque applied to the output member, (c) means yieldably urging the movable casing means angularly about said turn axis toward a preselected neutral position relative to the stationary casing means, (d) stationary electric terminal means fixed on the stationary casing means, (e) movable electric terminal means fixed on the movable casing means and electrically connected to the motor leads, (f) one of said terminal means including brush contact means, (g) the other of said terminal means including:

(i) primary electrically conductive segment means arranged to engage the brush contact means when the movable casing means is in said preselected neutral position, (ii) first auxiliary electrically conductive segment means spaced angularly about said turn axis from said primary electrically conductive segment means to engage said brush contact means when the movable casing means is turned through a preselected angle in a first direction from said neutral position; and (iii) a second auxiliary electrically conductive segment means spaced angularly about said turn axis from said primary electrically conductive segment means to engage said brush contact means when the movable casing means is turned through a preselected angle in a second direction from said neutral position, (h) and means for reversibly applying direct current power to said stationary electric terminal means.

2. A torque responsive motor-drive assembly according to claim 1 including a first diode electrically connecting the first auxiliary electrically conductive segment means to the primary electrically conductive segment means, and a second diode electrically connecting the second auxiliary electrically conductive segment means to the primary electrically conductive segment means.

3. A torque responsive motor-drive assembly according to claim 1 wherein the primary and auxiliary electrically conductive segment means are fixed to the movable casing means for angular movement therewith, and the brush contact means are fixed to the stationary casing means.

4. A torque responsive motor drive assembly according to claim 1 wherein said stationary casing means has a portion extending around said movable casing means, and resilient ring means interposed between said movable casing means and said stationary casing means for resiliently supporting the movable casing means for turning movement about said axis relative to the stationary casing means.

5. A torque responsive motor-drive assembly according to claim 1 wherein said primary electrically conductive segment means comprises two primary segments, said first auxiliary electrically conductive segment means being spaced angularly about said axis in one direction from one of said primary segments, said second auxiliary electrically conductive segment means being spaced angularly about said axis in a second direction from the other of said primary segments.

6. A torque responsive motor-drive assembly according to claim 5 wherein said primary and auxiliary electrically conductive segment means are fixed to the movable casing means for angular movement therewith, and the brush contact means are fixed to the stationary casing means.

7. A torque responsive motor-drive assembly according to claim 5 including a first diode electrically connecting the first auxiliary electrically conductive segment means to said one of said primary segments, and a second diode electrically connecting said second auxiliary electrically conductive segment means to said other of said primary segments.

8. A torque responsive motor-drive assembly according to claim 1 wherein said movable casing means includes a motor casing, said drive means including a planetary speed reduction gear assembly having a ring gear means fixed to the motor casing and substantially coaxial with said motor shaft, an input sun gear means on said motor shaft, an output planet carrier means mounted for rotation about an axis coaxial with said motor shaft, planet gear means rotatably mounted on the planet carrier means and meshing with the ring gear means, and means drivingly connecting said output planet carrier means to said output member.

9. A torque responsive motor drive assembly according to claim 8 wherein said stationary casing means has a portion extending around said motor casing, and resilient ring means interposed between said motor casing and said stationary casing means for resiliently supporting the motor casing for turning movement about said turn axis relative to the stationary casing means.

10. A torque responsive motor-drive assembly according to claim 9 wherein said stationary casing means has a second portion extending around said ring gear means, and a second resilient ring means interposed between said ring gear means and said stationary casing means.

11. A reversible torque responsive motor-drive assembly comprising, (a) a stationary casing means, (b) movable drive means mounted in the stationary casing means for limited angular movement relative thereto about a turn axis, said movable drive means including (i) a reversible direct-current motor having motor casing means and a motor shaft extending out of one end of said motor casing means, means mounting the motor casing means in the stationary casing means for turning movement relative thereto about a turn axis coaxial with said motor shaft, (ii) a planetary gear speed reducer means including a ring gear means fixed to one end of the motor casing means coaxial with the motor shaft, an input sun gear means on the motor shaft, an output planet carrier means mounted for rotation about an axis substantially coaxial with said turn axis and having planetary gear means rotatably mounted thereon and meshing with the ring gear means, (iii) a rotary output member drivingly connected to said output planet carrier means, said rotary output member being substantially coaxial with said turn axis, said motor being drivingly connected through said speed reducer means to said rotary output member to apply driving torque thereto, said drive means being arranged to apply torque to the motor casing means tending to turn the motor casing means about said turn axis in opposition to the driving torque applied to the output member, (c) means yieldably urging the motor casing means angularly about said turn axis toward a preselected angular position relative to the stationary casing means, (d) stationary electric terminal means fixed on the stationary casing means, (e) movable electric terminal means fixed on the motor casing means and electrically connected to the motor, (f) said stationary electric terminal means including brush contact means, (g) said movable electric terminal means including (i) primary electrically conductive segment means arranged to engage the brush contact means when the motor casing means is in said preselected angular position, (ii) first auxiliary electrically conductive segment means spaced angularly about said turn axis from said primary electrically conductive segment means to engage said brush contact means when the movable casing means is turned through a preselected angle in a first direction from said preselected angular position; and (iii) second auxiliary electrically conductive segment means spaced angularly about said turn axis from said primary electrically conductive segment means to engage said brush contact means when the movable casing means is turned through a preselected angle in a second direction from said preselected angular position, (h) and means for reversibly applying direct current power to said stationary electric terminal means.

12. A torque responsive motor-drive assembly according to claim 11 including a first diode electrically connecting the first auxiliary electrically conductive segment means to the primary electrically conductive segment means, and a second diode electrically connecting the second auxiliary electrically conductive segment means to the primary electrically conductive segment means.

13. A torque responsive motor-drive assembly according to claim 11 wherein said means mounting the motor casing means on the stationary casing means includes resilient ring means interposed between said motor casing means and said stationary casing means for resiliently supporting the motor casing means for turning movement about said turn axis relative to the stationary casing means.

14. A reversible torque responsive motor-drive assembly according to claim 11 including an end cap of non-conductive material fixed to an end of the motor casing means opposite said one end, said primary electrically conductive segment means and said first and second auxiliary electrically conductive segment means being mounted on said end cap.

15. A reversible torque responsive motor-drive assembly according to claim 14 wherein said stationary casing means includes first and second casing sections having respective first and second interengaging faces, said first and second casing sections having means at the interengaging faces thereof for receiving and locating said stationary electric terminal means with said brush contact means inside the stationary casing means.

16. In a traverse rod having carrier means movable along the rod, a pulley housing at one end of the rod, and traverse cord means for moving the carrier means along the rod, a traverse cord drive wheel rotatably mounted on the pulley housing, a torque responsive motor-drive assembly operatively connected to said traverse cord drive wheel comprising, (a) a stationary casing means mounted on the pulley housing, (b) movable drive means mounted in the stationary casing means for limited angular movement relative thereto about a turn axis, said movable drive means including (i) a reversible direct-current motor having motor casing means and a motor shaft extending out of one end of the motor casing means, means mounting the motor casing means on the stationary casing means for turning movement relative thereto about a turn axis coaxial with the motor shaft, (ii) planetary gear speed reducer means including a ring gear means fixed to said one end of the motor casing means coaxial with the motor shaft, an input sun gear means on the motor shaft, an output planet carrier means mounted for rotation about an axis substantially coaxial with said turn axis and having planetary gear means rotatably mounted thereon and meshing with the ring gear means, (iii) means for drivingly connecting said output planet carrier means to said traverse cord drive wheel with said traverse cord drive wheel substantially coaxial with said turn axis, said motor being drivingly connected through said speed reducer means to said traverse cord drive wheel to apply driving torque thereto, said drive means being arranged to apply torque to the motor casing means tending to turn the motor casing means about said turn axis in opposition to the driving torque applied to the cord drive wheel, (c) means yieldably urging the motor casing means angularly about said turn axis toward a preselected neutral position relative to the stationary casing means, (d) stationary electric terminal means fixed on the stationary casing means, (e) movable electric terminal means fixed on the motor casing means and electrically connected to the motor, (f) one of said terminal means including brush contact means, (g) the other of said terminal means including:

(i) primary electrically conductive segment means arranged to engage the brush contact means when the motor casing means is in said preselected neutral position, (ii) first auxiliary electrically conductive segment means spaced angularly about said turn axis from said primary electrically conductive segment means to engage said brush contact means when the movable casing means is turned through a preselected angle in a first direction from said preselected neutral position; and (iii) second auxiliary electrically conductive segment means spaced angularly about said turn axis from said primary electrically conductive segment means to engage said brush contact means when the movable casing means is turned through a preselected angle in a second direction from said preselected neutral position, (h) and means for reversibly applying direct current power to said stationary electric terminal means.

17. A traverse rod according to claim 16 wherein said means mounting the motor casing means on the stationary casing means includes resilient ring means interposed between said motor casing means and said stationary casing means for supporting the motor casing means for turning movement about said turn axis relative to the stationary casing means.

18. A traverse rod according to claim 16 wherein said traverse rod has front side and a rear side and a lengthwise extending slot in said rear side, rod end bracket means connected to the pulley housing and extending rearwardly from the traverse rod, said traverse cord drive wheel being mounted on the pulley housing for rotation about a horizontal pulley axis transverse to the traverse rod, the stationary casing means being mounted on the pulley housing to extend rearwardly therefrom alongside said end bracket means with said turn axis substantially aligned with the axis of said cord drive wheel.

19. In a traverse rod having carrier means movable along the rod and traverse means for moving the carrier means along the rod, a torque responsive motor-drive assembly for reversibly driving the traverse means comprising, (a) a stationary casing means fixed to the rod and a movable casing means mounted on the stationary casing means for limited angular movement relative thereto about a turn axis, (b) drive means in the movable casing means having a rotary output member operatively connected to said traverse means, reversible direct-current motor means having motor leads and a motor shaft, and means for drivingly connecting the motor shaft to said output member for applying driving torque thereto, said drive means being arranged to apply torque to said movable casing means tending to turn said movable casing means about said turn axis in opposition to the driving torque applied to the output member, (c) means yieldably urging the movable casing means angularly about said turn axis toward a preselected neutral position relative to the stationary casing means, (d) stationary electric terminal means fixed on the stationary casing means, (e) movable electric terminal means fixed on the movable casing means and electrically connected to the motor leads, (f) one of said terminal means comprising brush contact means, (g) the other of said terminal means including (i) primary electrically conductive segment means arranged to engage the brush contact means when the movable casing means is in said preselected neutral position, (ii) first auxiliary electrically conductive segment means spaced angularly about said turn axis from said primary electrically conductive segment means to engage said brush contact means when the movable casing means is turned in a first direction from said preselected neutral position; and (iii) second auxiliary electrically conductive segment means spaced angularly about said turn axis from said primary electrically conductive segment means to engage said brush contact means when the movable casing means is turned in a second direction from said preselected neutral position, (h) and means for reversibly applying direct current power to said stationary electric terminal means.

20. A traverse rod according to claim 19 including a first diode electrically connected to the first auxiliary electrically conductive segment means and the primary electrically conductive segment means, and a second diode electrically connected to the second auxiliary electrically conductive segment means and the primary electrically conductive segment means.

21. A traverse rod according to claim 19 wherein the primary and auxiliary electrically conductive segment means are fixed to the movable casing means for angular movement therewith, and the brush contact means are fixed to the stationary casing means.

* * * * *